US006419045B2

(12) United States Patent
Adshead

(10) Patent No.: US 6,419,045 B2
(45) Date of Patent: Jul. 16, 2002

(54) LADDERS

(76) Inventor: Harold Frederick Adshead, 31 Brattswood Drive, Stoke on Trent (GB), ST7 3EJ ( * ) Notice: Subject to any disclaimer, the term of this patent is extended or adjusted under 35 U.S.C. 154(b) by 0 days.

(21) Appl. No.: 09/755,061

(22) Filed: Jan. 8, 2001

(30) Foreign Application Priority Data

Feb. 15, 2000 (GB) ..... 0003309

(51) Int. Cl.[7] ..... E04G 5/02; E04G 1/00
(52) U.S. Cl. ..... 182/107; 182/129; 182/214
(58) Field of Search ..... 182/214, 107, 182/108, 129

(56) References Cited

U.S. PATENT DOCUMENTS 3,318,416 A * 5/1967 Robinson ..... 182/214
3,773,143 A * 11/1973 Del Prete et al. ..... 182/214
4,491,192 A * 1/1985 Skarsten ..... 182/107
4,580,660 A * 4/1986 Oling ..... 182/107
4,754,843 A 7/1988 Anderson
4,880,079 A * 11/1989 Leclerc ..... 182/107
4,974,699 A * 12/1990 Boring ..... 182/107
4,998,982 A * 3/1991 Arnold et al. ..... 182/107 X
5,833,028 A * 11/1998 Ramsey et al. ..... 182/108 X
5,881,838 A 3/1999 Swanick

FOREIGN PATENT DOCUMENTS

EP 0 771 931 A1 5/1997

* cited by examiner

*Primary Examiner*—Daniel P. Stodola
*Assistant Examiner*—Hugh B. Thompson
(74) *Attorney, Agent, or Firm*—Martin A. Hay

(57) ABSTRACT

An apparatus is provided for a portable ladder which has essentially parallel side members, the apparatus comprising having a pair of arcuate arms for attachment to the upper end of each side member of the ladder, at least one resilient roller mounted on a corresponding axle or axles located between and/or outwardly from the arms, a mechanism to locate each arm on each side member and a mechanism to secure the arms to the side member, the width of the roller being at least 50% of the distance between the arms. Also provided is a ladder fitted with the above apparatus. A ladder fitted with the apparatus enables easier working for a workman working at the top of the ladder and reduces possible damage to the surface on which the top of the ladder rests.

32 Claims, 1 Drawing Sheet

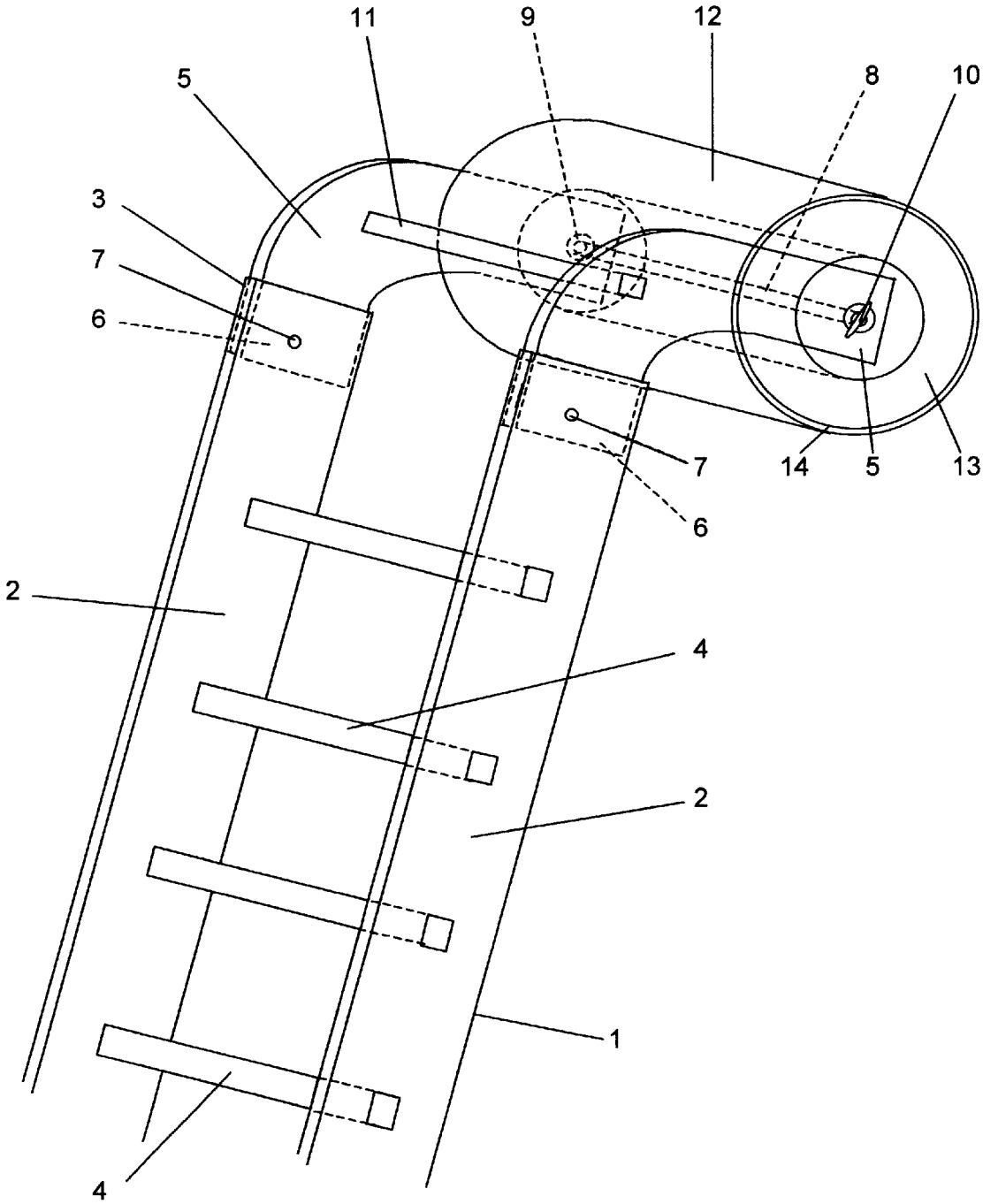
11
9
12
5
8
10
3
7
6
7
14
5
13
6
2
4
2
1
4

LADDERS

This invention relates to ladders and in particular to portable ladders.

Portable ladders usually comprise two side members, and interposed between the side members are located a plurality of conveniently spaced rungs. The number of rungs depends upon the length of the side members. Extending ladders comprise a number, generally two or three, of smaller ladders slidably disposed within the main ladder and capable of being secured to an upper rung of the main ladder. The side members of portable ladders are essentially parallel, although some portable single ladders may have converging or diverging side members, particularly at their upper ends. All these ladders are intended to rest at their lower end on the ground and at their upper end against a resting object. In this specification, the term "ground" includes any solid surface on which ladder is generally used, such as, for example, compacted soil, lawn, concrete, paving, wood, and the like. In this specification, the term "resting object" means the object against which the ladder rests such as for example, brickwork, roofing, guttering, scaffolding, tree, and the like.

The object of a ladder is to enable a workman to attain a greater working height. Such use is conventional and extends to the professional workman and the amateur user around the house.

Much damage can be caused to a resting object by inadvertent striking of the upper end of the ladder against the resting object when the ladder is being placed into position. For example, when a ladder is being positioned near a window for cleaning, the upper end of the ladder could break the window or damage the window frame; also for example, if a ladder is being used on a roof, slates or tiles, being the resting object, may be damaged if the ladder strikes the roof sharply when being positioned or manipulated on the roof. This is generally caused by the upper ends of the ladder being smacked against the resting object. Such damage may be very costly to make good, particularly if the windows, frames or roof are on an old building so that repair material is not readily available or unavailable.

There is therefore a need for an apparatus that can be used on ladders to enable the possibility of such damage to be eliminated or much reduced.

According to the present invention, an apparatus is provided for a portable ladder having essentially parallel side members which apparatus comprises having a pair of arms for attachment to the upper end of each side member of the ladder, at least one resilient roller mounted on a corresponding axle or axles located between and/or outwardly from the arms, means to locate each arm on each side member and means to secure the arms to the side member, the length of the roller being at least 50% of the distance between the arms.

The side members of conventional ladders often have an I or T shaped cross section, but preferably, principally for increased strength, have a rectangular or square box cross section. Such ladders are generally made from a light metal, such as for example, aluminium or aluminium alloy.

The arms of the apparatus of the present invention are conveniently made from similar metal, and have a cross section appropriate for attachment to the side member. Thus, where the side member has a square or rectangular cross section, the arms will have similar cross section, but larger or smaller dimension at the end of the arm to locate the arm on the side member so that that part of the arm may slide over or preferably within the side member. That end of the arm may be similarly adapted for location onto a side member having an I or T cross section. Because such location is slidable and the arm may disengage form the side member, means should be provided to secure the arm to the side member. The securing means should be releasable so that the apparatus of the invention can be removed from the ladder when not required. The securing means may be for example a bolt extending through both the arm and the side member, maintained in position by a nut or wing nut, but is preferably a spring catch, releasable when the apparatus is no longer required.

The arms should be essentially parallel, and may be straight or, preferably, arcuate. If arcuate, the ladder is then conveniently a short distance, typically about 15 cm to 50 cm, preferably 20 cm to 35 cm, from the resting surface so making work at or near the resting surface somewhat easier. By arcuate is meant that the arms progress through about 30° to 150°, preferably 60° to 120°, and most preferably essentially 90° through sharp angle or angles, or preferably through a smooth curve, preferably an arc.

The roller is mounted on, and can rotate, about the axle. The axle is preferably mounted between the arms, but may extend also or only outwardly from the arms. The axle is conveniently a rod which is provided with means to allow replacement of the roller; for example if the axle is located between and through the arms, it may be provided with a head at one end to abut the outside of one arm and a screw thread and wing nut at the outer end of the other arm.

By the term "roller" herein is comprehended a plurality of such rollers mounted on the same axle.

The roller may be made from any suitable resilient material. It may be made for example from synthetic or natural rubber, from flexible thermoplastic such as for example plasticised polyvinyl chloride, or from such materials which are in the form of a foam. A preferred roller is made from a foam, which is, provided with a harder, but still flexible, skin. The skin may be provided with ridges and dimples on its surface. In a preferred embodiment the roller is replaceable; in a further preferred embodiment the resilient material is replaceable. The length of the roller, if located between the side members, should be at least 50%, preferably at least 75% but no more than about 95% of the distance between the side members so that the roller may freely rotate about the axle. If a roller is located, or rollers are located, outside the side members, then the total length of these rollers should be at least 50%, preferably at least 75% of the distance between the side members.

In a further embodiment of the present invention, the arms are pivotally located and latchably secured to the upper end of at least one side member. Therefore the roller can be pivoted into a desired position, relevant to the particular job required of the ladder, and releasably maintained in that position. On release of the latch, the roller can be pivoted back to a storage position alongside (that is underneath) the ladder but not proud of the upper end of the ladder; such a storage position facilitates use of the ladder when the roller is not required, but enables easy use of the roller when desired. The latching means could be, for example, a friction device or preferably a ratchet device located at or adjacent the pivot.

Therefore in operation, the ladder is being placed against, for example, a window ledge or a roof, the roller spreads the load of the ladder and enables the ladder to more easily manipulated into the desired position, and without damaging or with minimum damage to the resting object.

The invention is illustrated with reference to the accompanying FIGURE which shows a portable ladder according to the invention.

The FIGURE shows the upper part of a conventional portable ladder 1 made from aluminium alloy and having side members 2 of rectangular cross section. The ladder is provided with conveniently spaced rungs 4. At the upper end 3 of the ladder is provided an apparatus according to the invention. The apparatus is provided with 2 arcuate arms 5 having similar cross section to the side members, but having smaller dimension at their lower end 6 to enable the arm to slide within the side member, and secured therein by releasable, spring biased pin 7. Between the arms 5 towards their upper end is provided an axle 8 having a head 9 at one end and a screw thread and wing nut 10 at the other to facilitate removal of the axle. An additional rung 11 is provided between the arms to give extra stability to the apparatus. Roller 12 is mounted on the axle 8. The roller extends about 80% of the distance between the side members. The roller is fabricated from flexible synthetic rubber foam inner 13, covered with a rubber skin 14.

In a first alternative embodiment, the axle 8 extends outwardly from each of the side members and a roller is located on each of the extensions.

In operation, the ladder is placed on the ground and positioned against a resting object such as a wall or a roof easily, smoothly and gently without any damage to the resting object. When no longer required, the apparatus can be removed from the ladder by depression of the spring biased pin 7 and sliding the apparatus from the upper end of the ladder.

What is claimed is:

1. An apparatus for a portable ladder having essentially parallel side members with upper and lower ends, which comprises a pair of arcuate arms for attachment within the upper end of each respective side member of the ladder, at least one resilient roller mounted on a corresponding axle or axles located between or outwardly from the arms, means to locate each of said arms on each side member and means to secure the arms to the side members, the length of the roller being at least 50% of the distance between the arms, and the arms having a length and the resilient roller having a diameter such that when in use the upper end of the ladder to which they are attachable is adapted to be at least 15 cm from a surface against which the roller rests.

2. An apparatus as claimed in claim 1 in which the arms progress smoothly through an angle of essentially 90°.

3. An apparatus as claimed in claim 1 in which the at least one roller is mounted on one of said axles between the two arms.

4. An apparatus as claimed in claim 1 in which the at least one roller is mounted on at least one of said axles extending outwardly from at least one side member.

5. An apparatus as claimed in claim 1 in which the arms have a rectangular cross section.

6. An apparatus as claimed in claim 1 in which the securing means is releasable.

7. An apparatus as claimed in claim 1 in which the roller has an external flexible skin.

8. An apparatus as claimed in claim 1 in which the roller is made from a thermoplastic foam.

9. An apparatus as claimed in claim 1 in which the roller is replaceable.

10. An apparatus as claimed in claim 1 in which the arms have a length and the resilient roller has a diameter such that when in use the upper end of the ladder to which they are attachable is adapted to be at least 20 cm from a surface against which the roller rests.

11. An apparatus as claimed in claim 1 in which at least one resilient roller is mounted on a corresponding axle or axles located between and outwardly from the arms.

12. An apparatus as claimed in claim 1 in which an additional rung is provided between the arms.

13. An apparatus as claimed in claim 1 in which the roller is mounted on an axle between the two arms, the roller is made from a thermoplastic foam that is provided with a flexible skin and an additional rung is provided between the arms.

14. A portable ladder fitted with an apparatus, said portable ladder having essentially parallel side members with upper and lower ends, and said apparatus comprising a pair of arcuate arms located and secured within each upper end of each respective side member, and at least one resilient roller mounted on a corresponding axle or axles located between or outwardly from the arms, the roller having length at least 50% of the distance between the arms, and the roller having a diameter and the arcuate arms each having a length such that the upper end of the ladder is at least 15 cm from a surface against which the ladder is to rest.

15. A portable ladder as claimed in claim 14 in which the at least one roller is mounted on a respective one of said axles between the two arms.

16. A portable ladder as claimed in claim 14 in which the roller is made from a thermoplastic foam that is provided with a flexible skin.

17. A portable ladder as claimed in claim 14 in which an additional rung is provided between the arms.

18. A portable ladder as claimed in claim 14 in which the at least one roller is mounted on a respective one of said axles between the two arms, the roller is made from a thermoplastic foam that is provided with a flexible skin, and an additional rung is provided between the arms.

19. An apparatus for a portable ladder having essentially parallel side members with upper and lower ends, which comprises a pair of arcuate arms for attachment to the upper end of each respective side member of the ladder, an additional rung between the arms, at least one resilient roller mounted on a corresponding axle or axles located between or outwardly from the arms, means to locate each of said arms on each side member and means to secure the arms to the side members, the length of the roller being at least 50% of the distance between the arms, and the arms having a length and the resilient roller having a diameter such that when in use the upper end of the ladder to which they are attachable is adapted to be at least 15 cm from a surface against which the roller rests.

20. An apparatus as claimed in claim 19 in which the arms progress smoothly through an angle of essentially 90°.

21. An apparatus as claimed in claim 19 in which the at least one roller is mounted on one of said axles between the two arms.

22. An apparatus as claimed in claim 19 in which the at least one roller is mounted on at least one of said axles extending outwardly from at least one side member.

23. An apparatus as claimed in claim 19 in which the arms have a rectangular cross section.

24. An apparatus as claimed in claim 19 in which the securing means is releasable.

25. An apparatus as claimed in claim 19 in which the roller has an external flexible skin.

26. An apparatus as claimed in claim 19 in which the roller is made from a thermoplastic foam.

27. An apparatus as claimed in claim 19 in which the roller is replaceable.

28. An apparatus as claimed in claim 19 in which the arms have a length and the resilient roller has a diameter such that when in use the upper end of the ladder to which they are attachable is adapted to be at least 20 cm from a surface against which the roller rests.

29. An apparatus as claimed in claim 19 in which at least one resilient roller is mounted on a corresponding axle or axles located between and outwardly from the arms.

30. A portable ladder fitted with an apparatus, said portable ladder having essentially parallel side members with upper and lower ends, and said apparatus comprising a pair of arcuate arms located and secured to each upper end of each respective aide member, an additional rung between the arms and at least one resilient roller mounted on a corresponding axle or axles located between or outwardly from the arms, the roller having length at least 50% of the distance between the arms, and the roller having a diameter and the arcuate arms each having a length such that the upper end of the ladder is at least 15 cm from a surface against which the ladder is to rest.

31. A portable ladder as claimed in claim 30 in which the at least one roller is mounted on a respective one of said axles between the two arms.

32. A portable ladder as claimed in claim 30 in which the roller is made from a thermoplastic foam that is provided with a flexible skin.

* * * * *